US009376816B2

(12) United States Patent
Anderson et al.

(10) Patent No.: US 9,376,816 B2
(45) Date of Patent: Jun. 28, 2016

(54) JOINTED METAL MEMBER

(76) Inventors: Scott J. Anderson, Lansing, MI (US); Jeffrey A. Anderson, Bradenton, FL (US)

( * ) Notice: Subject to any disclaimer, the term of this patent is extended or adjusted under 35 U.S.C. 154(b) by 0 days.

(21) Appl. No.: 13/702,811

(22) PCT Filed: Jun. 7, 2011

(86) PCT No.: PCT/US2011/039433

§ 371 (c)(1), (2), (4) Date: Mar. 28, 2013

(87) PCT Pub. No.: WO2011/156363

PCT Pub. Date: Dec. 15, 2011

(65) Prior Publication Data

US 2013/0174511 A1 Jul. 11, 2013

Related U.S. Application Data

(60) Provisional application No. 61/352,208, filed on Jun. 7, 2010, provisional application No. 61/436,921, filed on Jan. 27, 2011.

(51) Int. Cl.

| | |
|---|---|
| ***E04C 3/00*** | (2006.01) |
| ***E04C 3/08*** | (2006.01) |
| *E04C 3/04* | (2006.01) |

(52) U.S. Cl.

CPC ..... *E04C 3/086* (2013.01); *E04C 2003/0413* (2013.01); *Y10T 29/49826* (2015.01)

(58) Field of Classification Search

CPC ..... E04B 5/29; E04B 5/23; E04C 2003/0421; E04C 2003/0473; E04C 3/09; E04C 3/32; E04C 3/086

USPC ..... 52/836; 403/274, 382, 280

See application file for complete search history.

(56) References Cited

U.S. PATENT DOCUMENTS

| | | | | |
|---|---|---|---|---|
| 1,741,423 | A * | 12/1929 | Lachman | 52/636 |
| 4,732,028 | A | 3/1988 | Bodnar | |
| 4,909,007 | A | 3/1990 | Bodnar | |
| 5,207,045 | A | 5/1993 | Bodnar | |
| 5,588,273 | A * | 12/1996 | Csagoly | 52/634 |
| 5,669,197 | A | 9/1997 | Bodnar | |
| 7,797,908 | B2 * | 9/2010 | Keys | 52/846 |

OTHER PUBLICATIONS

International Preliminary Report on Patentability dated Dec. 20, 2012 for PCT/US2011/039433.

* cited by examiner

*Primary Examiner* — Mark Wendell

(74) *Attorney, Agent, or Firm* — Steptoe & Johnson LLP

(57) ABSTRACT

In one aspect, a metal construction member can include at least two metal strips. Each metal strip can have a continuous nonlinear pattern along one lengthwise edge of the strip, where the continuous nonlinear pattern can include a plurality of repeating units. Each repeating unit can include at least one joining region, which can protrude away from a lengthwise axis of the metal strip. At least one of the metal strips can be joined to at least one other metal strip at a plurality of adjacent joining regions.

28 Claims, 11 Drawing Sheets

JOINTED METAL MEMBER

CLAIM FOR PRIORITY

This application claims priority under 35 USC 371 to International Application No. PCT/US2011/039433, filed on Jun. 7, 2011, which claims priority to U.S. Provisional Application No. 61/352,208, filed Jun. 7, 2010, and U.S. Provisional Application No. 61/436,921, filed Jan. 27, 2011, each of which is incorporated by reference in its entirety.

TECHNICAL FIELD

The invention relates to an apparatus for manufacturing building materials, and more particularly to a metal framing member for structural and non-structural building applications.

BACKGROUND

The use of light gauge metal framing members for structural and non structural applications has grown in the residential and light commercial building industry due, in part, to volatile lumber costs and the inconsistent and unpredictable quality of wood studs. Although the use of metal in framing applications has increased over the last few years, a few issues have resulted in the rate of growth being inhibited. For example, over the last five years, the cost of steel has risen significantly. To offset rising cost of material, producers have reduced the material thickness. The thickness reduction has exacerbated the negative effects of the thinner and more flexible metal. These negative effects have prohibited further material thickness reduction opportunities.

SUMMARY

A metal construction member can include at least two metal strips. Each metal strip can include four edges, two widthwise edges and two lengthwise edges. A lengthwise edge can be longer than a widthwise edge. A metal can include any metal; however, preferably, a metal can include steel.

In some embodiments, each metal strip can have a pattern along at least one lengthwise edge of the strip. A pattern can be along a portion of an edge or can be along an entire lengthwise edge. A pattern can be designed to accommodate forces that a metal construction member can experience. A pattern can be a predetermined design. A design can be irregular (i.e. not repetitive or symmetrical), symmetrical, periodic (i.e. repetitive) or algorithmic (e.g. a sinusoidal wave). A pattern of each metal strip can be the same or the pattern of each metal strip can be different. In a preferred embodiment, a pattern along at least one lengthwise edge of a first metal strip can be complementary to a pattern along at least one lengthwise edge of a second metal strip.

In some embodiments, a pattern can be continuous. Continuous can mean that a pattern does not include any breaks or stops.

In some embodiments a pattern can be nonlinear (i.e. not a continuous straight line). However, a nonlinear pattern can include straight lines. For example, a nonlinear pattern could be a zig zag pattern, a sinusoidal pattern, a square-wave pattern, or a combination thereof.

In some embodiments, a pattern can be a continuous nonlinear pattern. In some embodiments, a continuous nonlinear pattern can include a plurality of repeating units. A repeating unit can be a portion of the pattern which can be repeated along the length of the pattern. A plurality of repeating units can include at least one, at least five, at least ten, at least fifteen, at least twenty, at least thirty, at least forty or at least fifty repeating units.

In some embodiments, each repeating unit can include a first half and a second half, preferably, the second half can be a mirror image of the first half. In some embodiments, if one pattern can be described in terms of different repeating units, and a repeating unit exists in which the second half is a mirror image of the first half (i.e. a symmetrical repeating unit), then the repeating unit can be defined as the symmetrical repeating unit.

In some embodiments, each repeating unit can include at least one joining region. A joining region can be a region of a unit that protrudes away from a lengthwise axis of the metal strip. A lengthwise axis can be an imaginary line that can bisect a metal strip. In some embodiments, a joining region can include any point or portion of the region that can protrude away. In some embodiments, a joining region can include the portion of the region that can protrude away the farthest.

In some embodiments, a pattern includes a plurality of joining regions. A plurality of joining regions can include at least one, at least five, at least ten, at least fifteen, at least twenty, at least thirty, at least forty or at least fifty joining regions.

In some embodiments, at least one of the metal strips can be joined to at least one other metal strip at a plurality of joining regions, for example a plurality of adjacent joining regions, along the lengthwise edge of one strip. In some embodiments, this can mean that a plurality of joining regions of a first metal strip can be joined to a second metal strip. In some embodiments, this can mean that a plurality of joining regions of a first metal strip can be joined to a plurality of joining regions of a second metal strip.

In some embodiments, a second metal strip can have a continuous nonlinear pattern along both lengthwise edges of the strip. A first metal strip can be joined to a second metal strip at a plurality of joining regions along a first lengthwise edge of the first metal strip. The second metal strip can also be joined to a third metal strip at a plurality of joining regions along a second lengthwise edge of the second metal strip. The plurality of joining regions can be adjacent.

This pattern can continue using a plurality of metal strips. In some embodiments, an at least one metal strip can include two, three, four, five or more metal strips. For example, as stated above, if there are three metal strips, a first metal strip can be joined to a second metal strip and the second metal strip can also be joined to a third metal strip. Additionally, if there are four metal strips, a first metal strip can be joined to a second metal strip, the second metal strip can also be joined to a third metal strip, and the third metal strip can also be joined to a fourth metal strip. In some embodiments, a first metal strip and a last metal strip, which each can only be joined to one other metal strip, can have a continuous pattern along one lengthwise edge of the strip and one lengthwise edge that can be linear.

In some embodiments, a metal construction member can further include a plurality of voids. A void can be an open space. A plurality of voids can at least one, at least five, at least ten, at least fifteen, at least twenty, at least thirty, at least forty or at least fifty voids. Because joining regions can protrude away from a lengthwise axis of a metal strip, when two adjacent joining regions of a first metal strip are joined with two adjacent joining regions of a second metal strip, a void can be created. In some embodiments, a void can be defined by the continuous nonlinear pattern of a first metal strip and the continuous nonlinear pattern of a second metal strip when the first metal strip is joined to a second metal strip at a plurality of adjacent joining regions.

In some embodiments, the at least two metal strips can include metal from a single metal sheet. In other words, the metal strips can be formed from the same metal sheet. In some embodiments, the at least two metal strips can include all of the metal from a single metal sheet. Put another way, the metal strips can be formed from the same metal sheet in such a way that there can be no excess, extraneous or scrap metal following formation of the metal strips.

In some embodiments, each joining region can include a width. In some embodiments, a joining region on a first metal strip and a joining region on a second metal strip that can be joined can have an equivalent width.

In some embodiments, the at least two metal strips can be welded to at least one other metal strip at a plurality of adjacent joining regions.

In some embodiments, the at least two metal strips include a reinforcement. In some embodiments, a reinforcement can be around a void or a plurality of voids. In some embodiments, a reinforcement can include a flange, bead, dart or dimple.

In some embodiments, a metal construction member can be a c-section member. In some embodiments, a metal construction member can be a track member.

In another aspect, a method of building a structure can include placing a metal construction member in a portion of a structure. In some embodiments, a metal construction member can include at least two metal strips. Each metal strip can include four edges, two widthwise edges and two lengthwise edges. A lengthwise edge can be longer than a widthwise edge. A metal can include any metal; however, preferably, a metal can include steel.

In some embodiments, each metal strip can have a pattern along at least one lengthwise edge of the strip. A pattern can be along a portion of an edge or can be along an entire lengthwise edge. A pattern can be designed to accommodate forces that a metal construction member can experience. A pattern can be a predetermined design. A design can be irregular (i.e. not repetitive or symmetrical), symmetrical, periodic (i.e. repetitive) or algorithmic (e.g. a sinusoidal wave). A pattern of each metal strip can be the same or the pattern of each metal strip can be different. In a preferred embodiment, a pattern along at least one lengthwise edge of a first metal strip can be complementary to a pattern along at least one lengthwise edge of a second metal strip.

In some embodiments, a pattern can be continuous. Continuous can mean that a pattern does not include any breaks or stops.

In some embodiments a pattern can be nonlinear (i.e. not a continuous straight line). However, a nonlinear pattern can include straight lines. For example, a nonlinear pattern could be a zig zag pattern.

In some embodiments, a pattern can be a continuous nonlinear pattern. In some embodiments, a continuous nonlinear pattern can include a plurality of repeating units. A repeating unit can be a portion of the pattern which can be repeated along the length of the pattern. A plurality of repeating units can include at least one, at least five, at least ten, at least fifteen, at least twenty, at least thirty, at least forty or at least fifty repeating units.

In some embodiments, each repeating unit can include a first half and a second half, preferably, the second half can be a mirror image of the first half. In some embodiments, if one pattern can be described in terms of different repeating units, and a repeating unit exists in which the second half is a mirror image of the first half (i.e. a symmetrical repeating unit), then the repeating unit can be defined as the symmetrical repeating unit.

In some embodiments, each repeating unit can include a length. In some embodiments, each repeating unit can include a first half and a second half, such that the second half is a mirror image of the first half. In some embodiments, if one pattern can be described in terms of different repeating units and a repeating unit exists in which the second half can be a mirror image of the first half (i.e. a symmetrical repeating unit), then the repeating unit can be defined by the symmetrical repeating unit.

In some embodiments, each repeating unit can include at least one joining region. A joining region can be a region of a unit that protrudes away from a lengthwise axis of the metal strip. A lengthwise axis can be an imaginary line that can bisect a metal strip. In some embodiments, a joining region can include any point or portion of the region that can protrude away. In some embodiments, a joining region can include the portion of the region that can protrude away the farthest.

In some embodiments, a pattern includes a plurality of joining regions. A plurality of joining regions can include at least one, at least five, at least ten, at least fifteen, at least twenty, at least thirty, at least forty or at least fifty joining regions.

In some embodiments, at least one of the metal strips can be joined to at least one other metal strip at a plurality of joining regions, for example a plurality of adjacent joining regions, along the lengthwise edge of one strip. In some embodiments, this can mean that a plurality of joining regions of a first metal strip can be joined to a second metal strip. In some embodiments, this can mean that a plurality of joining regions of a first metal strip can be joined to a plurality of joining regions of a second metal strip.

In some embodiments, a second metal strip can have a continuous nonlinear pattern along both lengthwise edges of the strip. A first metal strip can be joined to a second metal strip at a plurality of joining regions along a first lengthwise edge of the first metal strip. The second metal strip can also be joined to a third metal strip at a plurality of joining regions along a second lengthwise edge of the second metal strip. The plurality of joining regions can be adjacent.

This pattern can continue using a plurality of metal strips. In some embodiments, an at least one metal strip can include two, three, four, five or more metal strips. For example, as stated above, if there are three metal strips, a first metal strip can be joined to a second metal strip and the second metal strip can also be joined to a third metal strip. Additionally, if there are four metal strips, a first metal strip can be joined to a second metal strip, the second metal strip can also be joined to a third metal strip, and the third metal strip can also be joined to a fourth metal strip. In some embodiments, a first metal strip and a last metal strip, which each can only be joined to one other metal strip, can have a continuous pattern along one lengthwise edge of the strip and one lengthwise edge that can be linear.

In some embodiments, a metal construction member can further include a plurality of voids. A void can be an open space. A plurality of voids can at least one, at least five, at least ten, at least fifteen, at least twenty, at least thirty, at least forty or at least fifty voids. Because joining regions can protrude away from a lengthwise axis of a metal strip, when two adjacent joining regions of a first metal strip are joined with two adjacent joining regions of a second metal strip, a void can be created. In some embodiments, a void can be defined by the continuous nonlinear pattern of a first metal strip and the continuous nonlinear pattern of a second metal strip when the first metal strip is joined to a second metal strip at a plurality of adjacent joining regions.

In some embodiments, the at least two metal strips can include metal from a single metal sheet. In other words, the metal strips can be formed from the same metal sheet. In some embodiments, the at least two metal strips can include all of the metal from a single metal sheet. Put another way, the metal strips can be formed from the same metal sheet in such a way that there can be no excess, extraneous or scrap metal following formation of the metal strips.

In some embodiments, each joining region can include a width. In some embodiments, a joining region on a first metal strip and a joining region on a second metal strip that can be joined can have an equivalent width.

In some embodiments, the at least two metal strips can be welded to at least one other metal strip at a plurality of adjacent joining regions.

In some embodiments, the at least two metal strips include a reinforcement. In some embodiments, a reinforcement can be around a void or a plurality of voids. In some embodiments, a reinforcement can include a flange, bead, dart or dimple.

In some embodiments, a metal construction member can be a c-section member. In some embodiments, a metal construction member can be a track member.

In another aspect, a method of manufacturing a metal construction member can include forming at least two metal strips. Each metal strip can include four edges, two widthwise edges and two lengthwise edges. A lengthwise edge can be longer than a widthwise edge. A metal can include any metal; however, preferably a metal can include steel.

In some embodiments, each metal strip can have a pattern along at least one lengthwise edge of the strip. A pattern can be along a portion of the edge or can be along the entire lengthwise edge. A pattern can be designed to accommodate forces which the metal construction member will experience. A pattern can be a predetermined design. A design can be irregular, regular, periodic or algorithmic. A pattern of each metal strip can be the same or a pattern of each metal strip can be different. In a preferred embodiment, a pattern along at least one lengthwise edge of a first metal strip can be complementary to a pattern along at least one lengthwise edge of a second metal strip.

In some embodiments, a pattern can be continuous. Continuous can mean that a pattern does not include any breaks or stops.

In some embodiments, a pattern can be nonlinear (i.e. not a continuous straight line). However, a nonlinear pattern can include straight lines. For example, a continuous nonlinear pattern can include a zig zag pattern.

In some embodiments, a pattern can be a continuous nonlinear pattern.

In some embodiments, a continuous nonlinear pattern can include a plurality of repeating units. A repeating unit can be a portion of a pattern that replicates along the length of the pattern. A plurality of repeating units can at least one, at least five, at least ten, at least fifteen, at least twenty, at least thirty, at least forty or at least repeating units.

In some embodiments, each repeating unit can include a first half and a second half, preferably, the second half can be a mirror image of the first half. In some embodiments, if one pattern can be described in terms of different repeating units, and a repeating unit exists in which the second half is a mirror image of the first half (i.e. a symmetrical repeating unit), then the repeating unit can be defined as the symmetrical repeating unit.

In some embodiments, each repeating unit can include at least one joining region. A joining region can be a region of a unit that can protrude away from a lengthwise axis of the metal strip. A lengthwise axis can be an imaginary line which can bisect a metal strip. In some embodiments, a joining region can include any point or portion of a joining region that protrudes away. In some embodiments, a joining region can include a portion of a joining region that protrudes away the farthest.

In some embodiments, a pattern includes a plurality of joining regions. A plurality of joining regions can include at least one, at least five, at least ten, at least fifteen, at least twenty, at least thirty, at least forty or at least fifty joining regions.

In some embodiments, a method can include aligning a plurality of adjacent joining regions of one metal strip with a plurality of adjacent joining regions of the other metal strip.

In some embodiments, aligning can include traversing at least one metal strip at a different rate than at least one other metal strip. In some embodiments, aligning can include shifting at least one metal strip in a direction parallel to the lengthwise axis of at least one other metal strip.

In some embodiments, wherein aligning can include shifting a first metal strip relative to a second metal strip a distance equivalent to a fraction a length of a repeating unit. In some embodiments, a first metal strip can be shifted relative to the second metal strip a distance equivalent to one half of the length of a repeating unit.

In some embodiments, a method can include joining at least one metal strip to at least one other metal strip at the plurality of joining regions, thereby forming a metal construction member. In some embodiments, a plurality of joining regions can be a plurality of adjacent joining regions.

In some embodiments, joining at least one metal strip to at least one other metal strip at the plurality of adjacent joining regions can mean joining a plurality of joining regions of a first metal strip to a second metal strip. In some embodiments, joining at least one metal strip to at least one other metal strip at the plurality of adjacent joining regions can mean joining a plurality of joining regions of a first metal strip to a plurality of joining regions of a second metal strip.

In some embodiments, a second metal strip can have a continuous nonlinear pattern along both lengthwise edges of the strip. Therefore, in some embodiments, a method can include joining a first metal strip to a second metal strip at the plurality of joining regions and joining a second metal strip to a third metal strip at the plurality of joining regions, thereby forming the metal construction member. A plurality of joining regions can be a plurality of adjacent joining regions.

This model of joining metal strips can continue using a plurality of metal strips. In some embodiments, the at least one metal strip can include two, three, four, five or more strips. For example, as stated above, a method can include joining a first metal strip to a second metal strip at the plurality of joining regions, and joining the second metal strip to a third metal strip at the plurality of joining regions, thereby forming the metal construction member. Additionally, if there are four metal strips, a method can include joining a first metal strip to a second metal strip at the plurality of joining regions, joining the second metal strip to a third metal strip at the plurality of joining regions, and joining the third metal strip to a fourth metal strip at the plurality of joining regions, thereby forming the metal construction member. The plurality of joining regions can be a plurality of adjacent joining regions.

In some embodiments, joining a plurality of adjacent joining regions of a first metal strip with a plurality of adjacent joining regions of a second metal strip can create a plurality of voids. A void can be an open space. A plurality of voids can at least one, at least five, at least ten, at least fifteen, at least twenty, at least thirty, at least forty or at least fifty voids. Because joining regions can protrude away from a lengthwise axis of a metal strip, when two adjacent joining regions of a first metal strip are joined with two adjacent joining regions of a second metal strip, a void can be created. In some embodiments, a void can be defined by a continuous nonlinear pattern of a first metal strip and a continuous nonlinear pattern of a second metal strip when the first metal strip is joined to a second metal strip at a plurality of adjacent joining regions.

In some embodiments, forming at least two metal strips can include creating a continuous nonlinear slit in a metal sheet. A slit can pass through a metal sheet. A slit can run the entire length of a metal sheet.

In some embodiments, forming an at least one continuous nonlinear slit can include cutting or punching the slit into a metal sheet. In some embodiments, the at least one continuous nonlinear slit can be cut or punched into the metal sheet by a rotary slitter, punch press, radial embosser, laser cutter, plasma cutter or water jet cutter.

In some embodiments, forming at least two metal strips can further include separating a metal sheet into at least two metal strips along an at least one continuous nonlinear slit. In some embodiments, separating a metal sheet into at least two metal strips along an at least one continuous nonlinear slit can result in a first metal strip having a pattern along at least one lengthwise edge of the strip and a second metal strip having a pattern along at least one lengthwise edge of the strip, where the pattern of the second metal strip can be complementary to the pattern of the first metal strip.

In some embodiments, joining a plurality of adjacent joining regions of a first metal strip with a plurality of adjacent joining regions of a second metal strip can include welding.

In some embodiments, a method can further include modifying a portion of the at least two metal strips to include a reinforcement. In some embodiments, a reinforcement can be around the plurality of voids. In some embodiments, a reinforcement can include a flange, bead, dart or dimple.

In some embodiments, a method can further include forming the metal construction member into a c-section member.

In some embodiments, a method can further include heat treating a metal construction member.

Other embodiments are within the claims.

DETAILED DESCRIPTION

Figure 1:
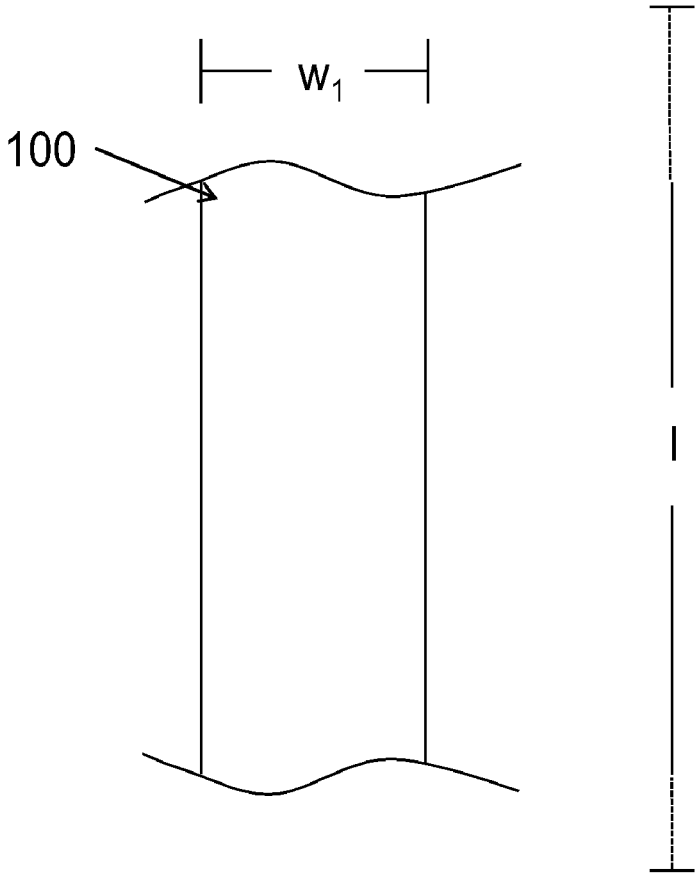
FIG. 1 is a view of a metal sheet.

Certain aspects of steel framing members are described, for example, in Application No. PCT/US11/23367, filed Feb. 1, 2011, U.S. Application No. 61/300,286, filed Feb. 1, 2010, U.S. Application No. 61/300,283, filed Feb. 1, 2010, U.S. application Ser. No. 12/395,934, filed Mar. 2, 2009, U.S. Application No. 61/032,195, filed Feb. 28, 2008, U.S. application Ser. No. 11/182,810, filed Jul. 18, 2005, U.S. Application No. 60/588,798, filed Jul. 19, 2004, U.S. application Ser. No. 10/633,694, filed Aug. 5, 2003, and U.S. Application No. 60/401,084, filed Aug. 5, 2002, each of which is incorporated by reference in its entirety.

Structural and non-structural steel construction members can be c-section in design. The c-section member can be a popular design that is used in most forms of commercial and some residential wall construction. A c-section member can be designed to hold sheets of building material such as drywall or other similar flat sheets by way of nails, screws and adhesives through flat or dimpled surfaces that are joined with a substantially solid web design. The cross section of the part can resemble the letter "C", which is why the member can be referred to as a "c-section" member. A c-section member can also add structural characteristics to the wall system when building materials are attached. C-section members can also be designed to allow plumbing and wiring to pass through and be hidden within the wall cavity.

As the cost of steel has fluctuated and competitive pressures have grown, the need to reduce the amount of steel used to produce the member has driven the producers of construction members to look for alternative designs that will reduce the cost of manufacture. Previous attempts to reduce cost have involved decreasing the overall thickness of the member and increasing the yield strength of the steel used. One problem with this approach can be that it results in a compromise of the strength of the member and it can make it more difficult to build the wall.

Therefore, a need exists for a metal construction member, for example a c-section member, with torsional and material strength that can be manufactured using a minimal amount of material and at a reduced cost.

One approach can include removing material in areas of the stud and create strategically placed voids in the web of material located between two building material mounting flanges. In order to maintain the strength of the original design, beads and or flanges can be placed around the void and can strengthen the web. This can result in a member that can be equal in strength and performance to the non-material reduced design, while it can allow a significant cost reduction. The revised design can also make it easier to install plumbing and wiring without as much on site modifications. Another benefit of this invention can be a reduction in the amount of material that will transfer thermal energy and sound energy. These characteristics can be positive and can lead to a less expensive wall construction to overcome these issues. To make this equal performing, cost reduced part possible, a method of manufacturing can involve creating material voids without scraping any of the material. Another advantage of this design can be the relative ease to manufacture. This design can allow for a separate machine that can be mounted prior to the current c-section forming machinery but after the existing coil handling equipment. The separate, standalone machine can allow the stud manufacturer to utilize the majority of his existing capital equipment, but the machine could use a smaller coil width steel to produce the final part.

In general, a method can involve continuously slitting a coil of a predetermined width with a specific pattern. The slit can create two continuous pieces with a pattern from one strip of metal. This pattern can be offset and reconnected or joined. One method of joining the two strips of material can be mash seam welding. Other methods can include use of a laser or induction, but any method to securely connect the strips would be acceptable.

More specifically, referring to FIG. 1, a method can include providing a metal sheet 100, which can be a single sheet of coiled strip material as it is uncoiled from the larger coil. A metal sheet can include any metal, most preferably, a metal sheet includes steel. A metal sheet can include a width ($w_1$) and a length (l), where a width of a metal sheet can be smaller than a length of a metal sheet.

Figure 2:
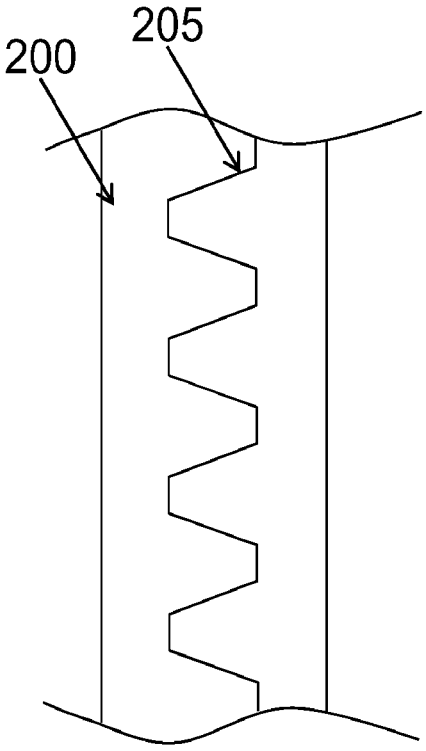
FIG. 2 is a view of a metal sheet.

Referring to FIG. 2, a method can include forming at least two metal strips. Forming at least two metal strips can include creating a continuous nonlinear slit 205 in a metal sheet 200. As shown, a slit can run the entire length of a metal sheet. The slit can be formed in the metal sheet using any number of techniques known to those of skill in the art, including cutting or punching the slit into a metal sheet. The slit can be cut or punched into the metal sheet by a rotary slitter, punch press, radial embosser, laser cutter, plasma cutter or water jet cutter.

Figure 3:
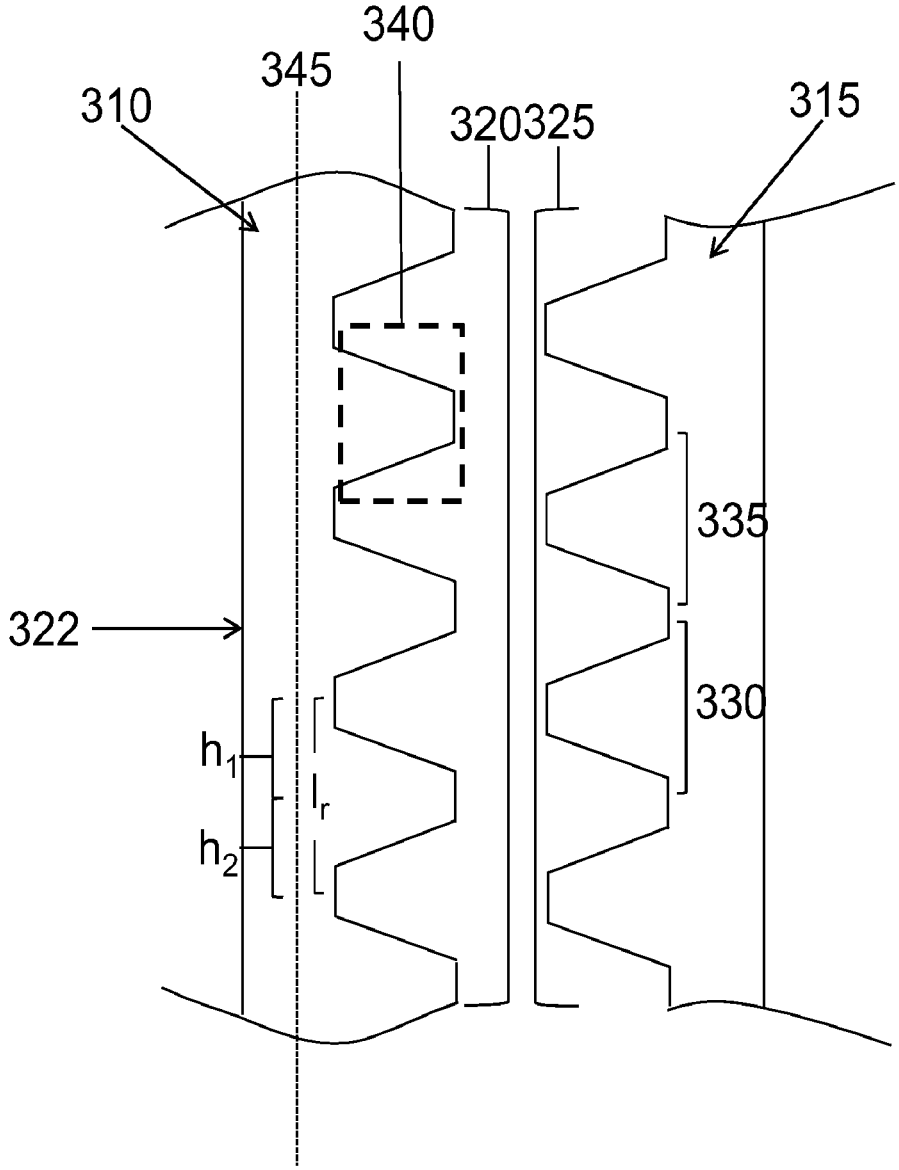
FIG. 3 is a view of metal strips.

Referring to FIG. 3, a method can include separating a metal sheet into at least two metal strips 310, 315 along an at least one continuous nonlinear slit. Separating a metal sheet into at least two metal strips 310, 315 along an at least one continuous nonlinear slit can result in a first metal strip 310 having a pattern 320 along at least one lengthwise edge of the strip and a second metal strip 315 having a pattern 325 along at least one lengthwise edge of the strip, where the pattern 325 of the second metal strip 315 can be complementary to the pattern 320 of the first metal strip 310. One lengthwise edge of a metal strip can be a linear edge 322.

A pattern can be a continuous nonlinear pattern 320, 325. As shown in FIG. 3, a nonlinear pattern can include straight lines; however, a nonlinear pattern cannot be a single straight line. A continuous nonlinear pattern can include a plurality of repeating units 335. A repeating unit can have a length ($l_r$), a first half ($h_1$) and a second half ($h_2$). A repeating unit can be defined first by a symmetrical repetitive section of a pattern, and if a symmetrical repetitive section does not exist, then by a repetitive section of the pattern. For example, in FIG. 3, the pattern can be defined by the symmetrical repetitive section 335. Therefore, the repeating unit can be the symmetrical repetitive section 335. However, if a symmetrical repetitive section of the pattern did not exist, then the repeating unit could be a repetitive section 330.

Each repeating unit 335 can include at least one joining region 340, which can be a region of a unit that protrudes away from a lengthwise axis 345 of the metal strip 310, 315.

Figure 4:
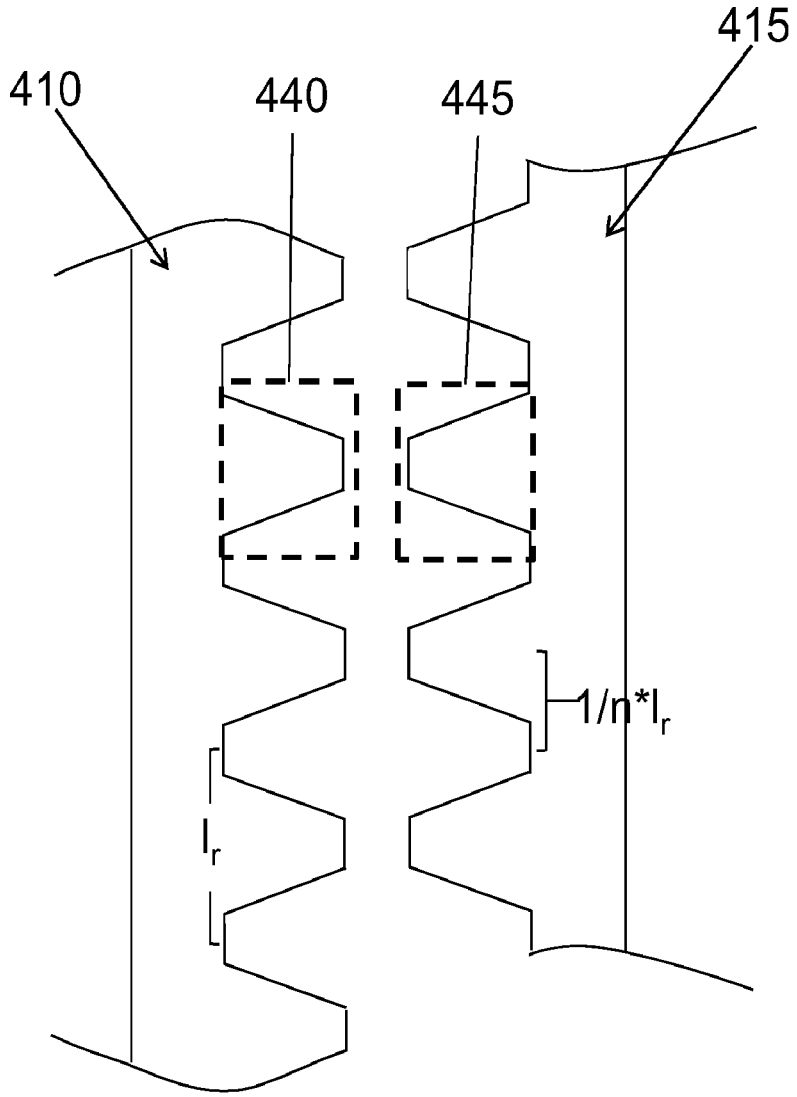
FIG. 4 is a view of metal strips.

Referring to FIG. 4, a method can include aligning a plurality of joining regions 440 of one metal strip 410 with a plurality of joining regions 445 of the other metal strip 415. Aligning can include shifting a first metal strip 410 relative to a second metal strip 415 a distance equivalent to a fraction a length of a repeating unit ($1/n*l_r$), for example shifting a distance equal to one half of the length of a repeating unit ($\frac{1}{2}*l_r$). See FIG. 4. As shown in FIG. 4, a metal strip 415 can be shifted in a direction parallel to the lengthwise axis of metal strip 410 (i.e. longitudinally).

Figure 5:
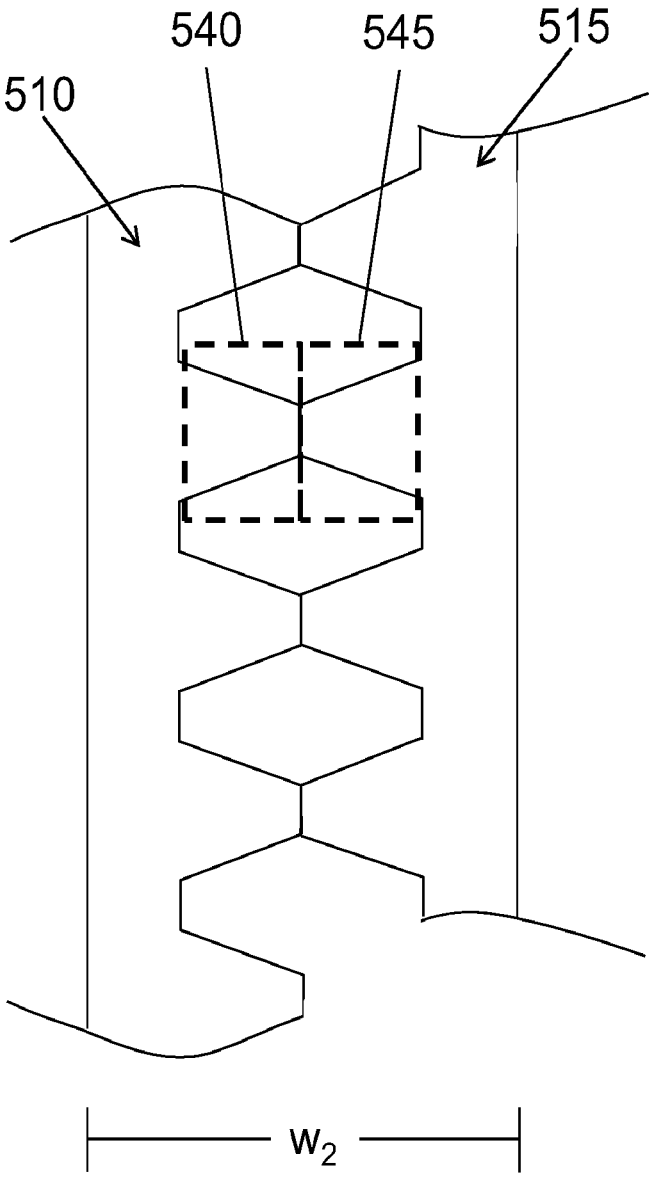
FIG. 5 is a view of a metal construction member.

Referring to FIG. 5, a method can include joining a metal strip 510 to another metal strip 515 at the plurality of joining regions 540, 545, thereby forming a metal construction member 555. Joining a plurality of adjacent joining regions 540 of a first metal strip 510 with a plurality of adjacent joining regions 545 of a second metal strip 515 can create a plurality of voids 550. A void 550 can be an open space. A void 550 can be defined by a continuous nonlinear pattern of a first metal strip and a continuous nonlinear pattern of a second metal strip when the first metal strip 510 is joined to a second metal strip 515 at a plurality of adjacent joining regions. Consequently, one way to alter the metal portion and/or voids can include altering the pattern of each of the metal strips.

The joining regions 540, 545, and accordingly the metal strips 510, 515, can be joined by any method known to those of skill in the art, including mash seam weld, laser, induction seam, Tig, or Mig. Joining the metal strips 510, 515 can increase the overall width ($w_1$ to $w_2$).

Figure 6:
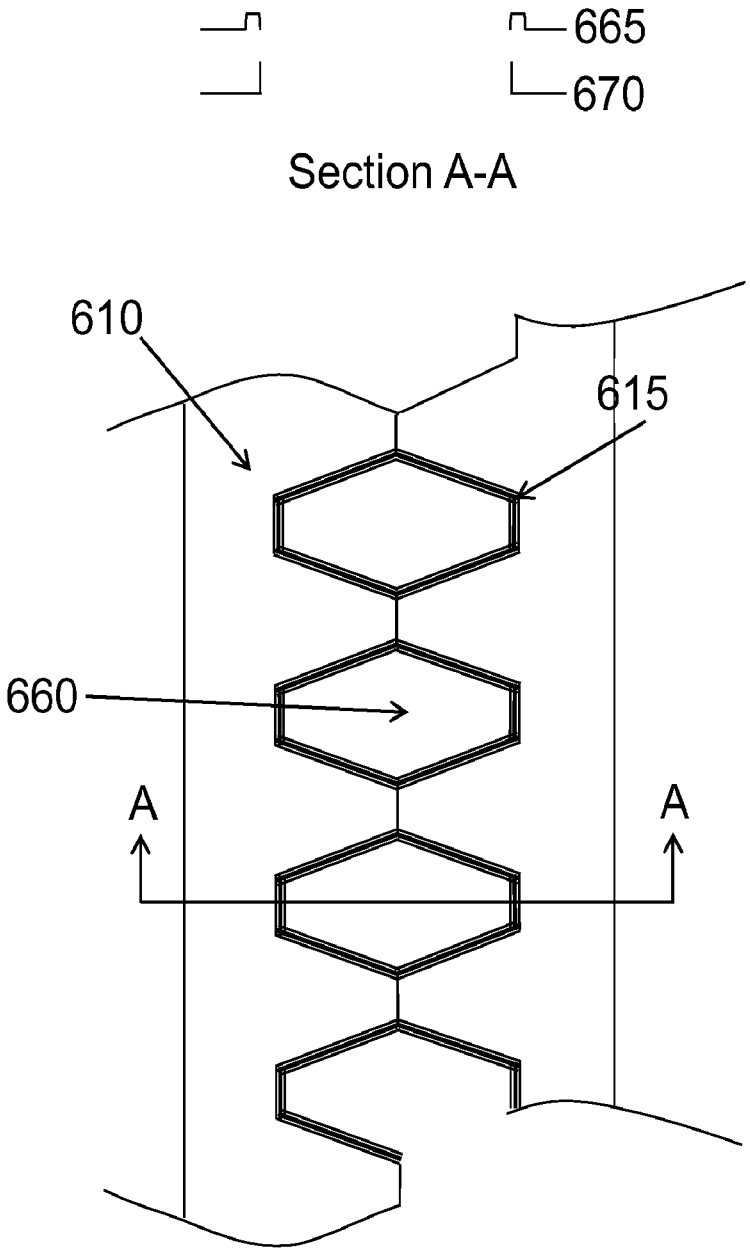
FIG. 6 is a view of a metal construction member.

Referring to FIG. 6, a method can include modifying a portion of a metal strip 610, 615 to include a reinforcement 660. A reinforcement can include a bead 665 or a flange 670. A reinforcement 660 can be around a void 650. Reinforcements, including beads and flanges, can be added around the circumference of the void to replace the structural strength lost from the material voids. However, in cases where the void size is small, reinforcements, including flanging or beads, may not be required to meet the member strength requirements. While reinforcements, including holes, voids, flanging, beads, dimples and/or darts, are functional enhancements, they can add cost to the manufacturing process and selling price.

Figure 7:
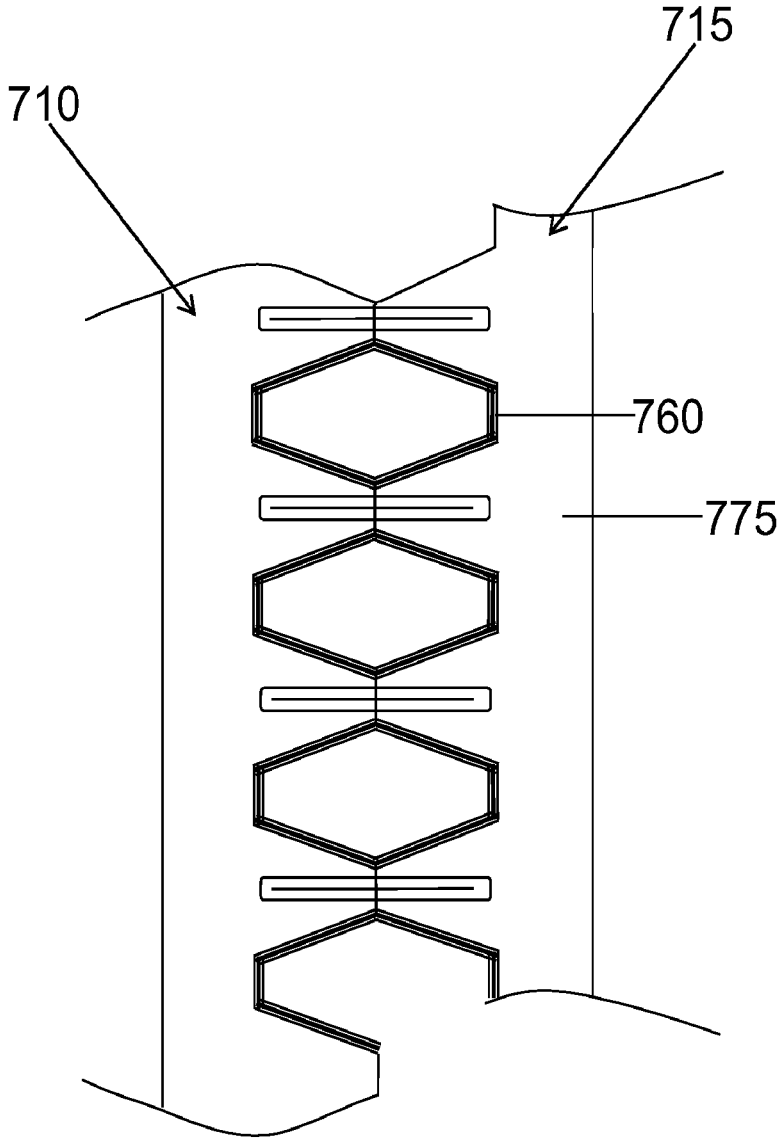
FIG. 7 is a view of a metal construction member.

Referring to FIG. 7, a reinforcement 660 can be at additional places on a metal sheet. For example, a reinforcement 775 can be located at a joining region 740, 745. The reinforcements can be added at strategic locations to further enhance desired characteristics, which can include thermal and sound transmission reduction.

Additional voids can be added to the member (not shown). The voids can be used for passing wiring and plumbing through the stud without affecting the performance of the final wall. These voids may not be intended to reduce cost as they can be relatively small and can be spaced specifically not to affect strength or the performance.

Figure 8:
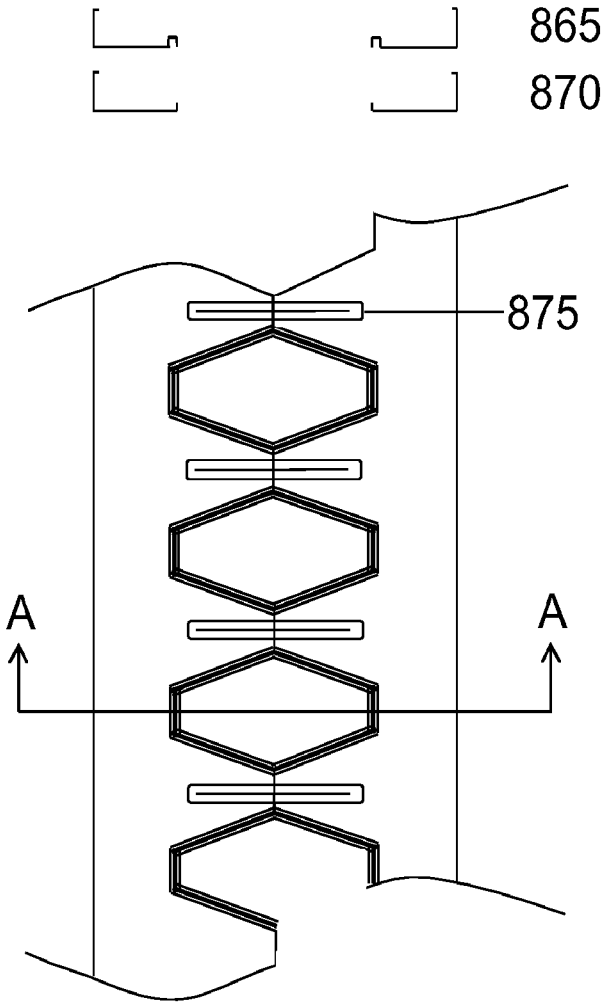
FIG. 8 is a view of a metal construction member.

Referring to FIG. 8, a method can include forming the metal construction member into a c-section member. See Section A-A, FIG. 8. A number of methods for forming a c-section member are known to those of skill in the art. Additionally, as shown in FIG. 8, a reinforcement can be used to strengthen a c-section member. The reinforcement can include a bead 865 or a flange 870. The metal construction member can also be formed into a track member (not shown). Track can be used to hold wall members to ceilings and floors, both structural and non-structural.

A joining member can include a reinforcement 875. A reinforcement 875 can be located across a joining member of a first metal strip and a joining member of a second metal strip.

The reconnected metal can result in a wider width than the original coil width. A pattern can result in a wider member from the original coil and can also create voids of a specific size and shape.

It may be desirable that the members be a custom length. A custom length can require a plurality of voids and plurality of joining regions to be consistently spaced so that the configuration of the ends of the member can be consistent. It may also be required so that a plurality of voids of one member line up with a plurality of voids of other members. In this way, straight items such as plumbing and rigid conduit can be passed through the wall without having to modify any of the members in the same wall.

The design of a pattern, including the shape and repeating unit of the pattern, can also depend upon the desired final shape and size of the voids necessary.

Figure 9:
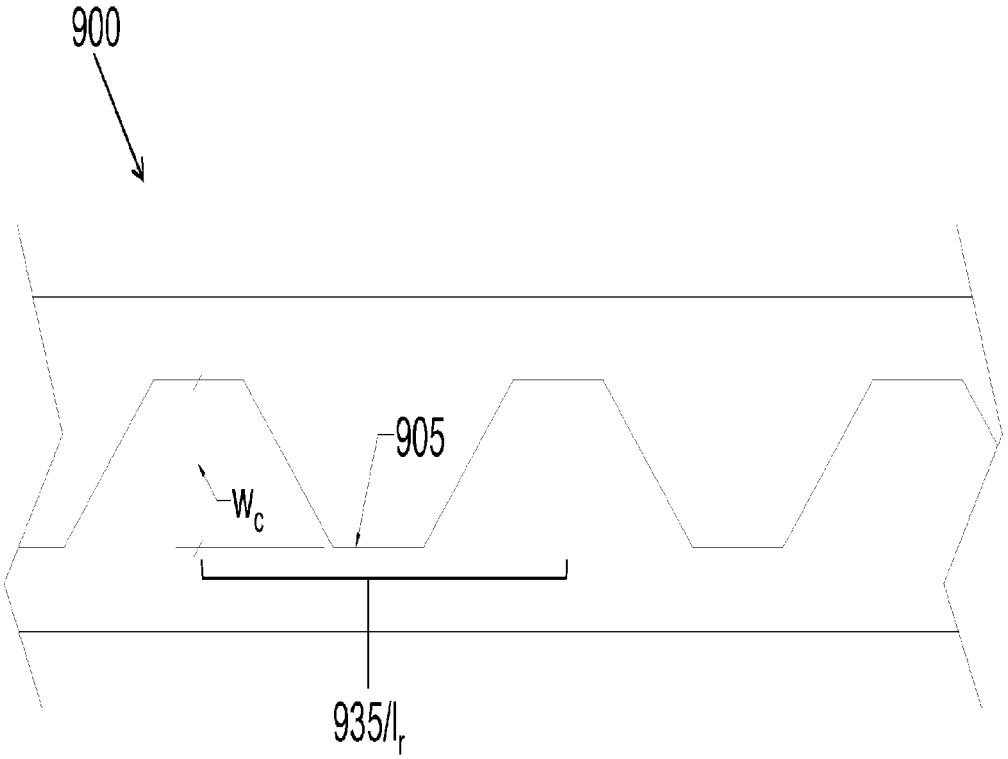
FIG. 9 is a view of a metal sheet.

FIG. 9 shows a diagram showing a continuous nonlinear slit 905, repeating unit 935, a length of a repeating unit ($l_r$) and width of cut ($w_c$). Referring to FIG. 9, consistent positioning of a plurality of voids can be achieved by adjusting a distance ($l_r$) equivalent to the length of a repeating unit 980. The ability to adjust the length ($l_r$) for each production run can allow the manufacturer to give the customer the specific length member they are looking for and can also ensure the voids are aligned.

Figure 10:
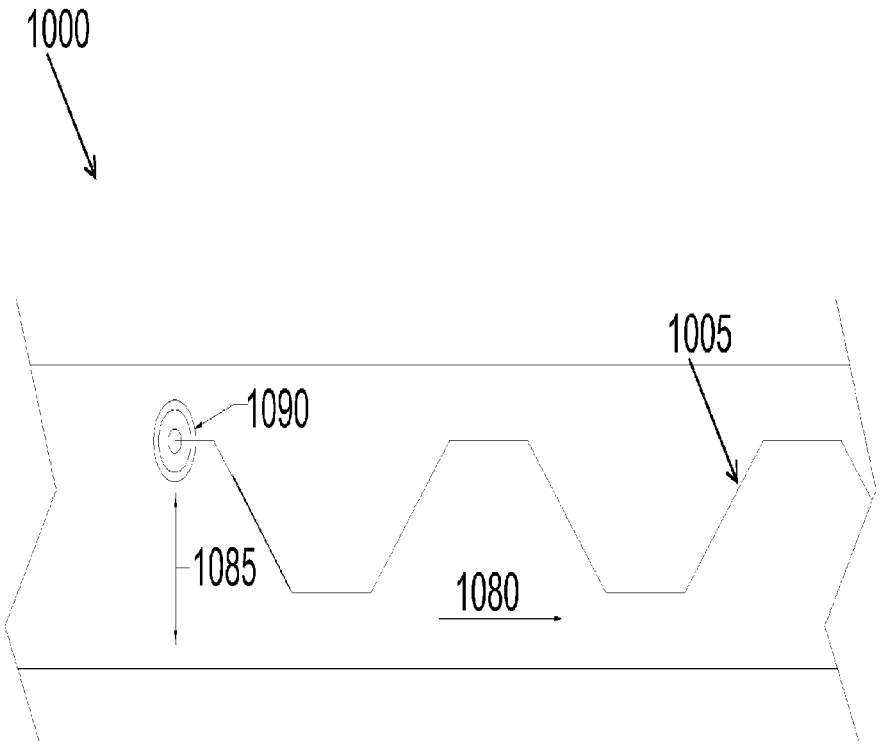
FIG. 10 is a view of a metal sheet with a cutting device.

FIG. 10 shows a diagram of an example of an actuator controlled cutter and relationship to strip material. Referring to FIG. 10, one method to achieve the variable pitch pattern can include using a computer controlled cutting tool such as a plasma cutter, water jet cutter, laser cutter or any other single point cutter that can be mounted to an actuator 1090. The actuator 1090 can move the cutter perpendicular 1085 to a metal strip or a direction a metal strip is traversing 1080. The cut can be programmed to cut based on the speed of the strip is moving. The computer can be programmed to change the length and width of cut relative to the custom length desired. An operator interface can allow the operator to enter the desired length of part, and the computer can automatically adjust the length of pitch or unit and/or any other parameters that would make an acceptable part. The interface can also allow the operator to adjust any other critical parameters necessary such as quantity, material thickness, width of cut, etc.

Figure 11:
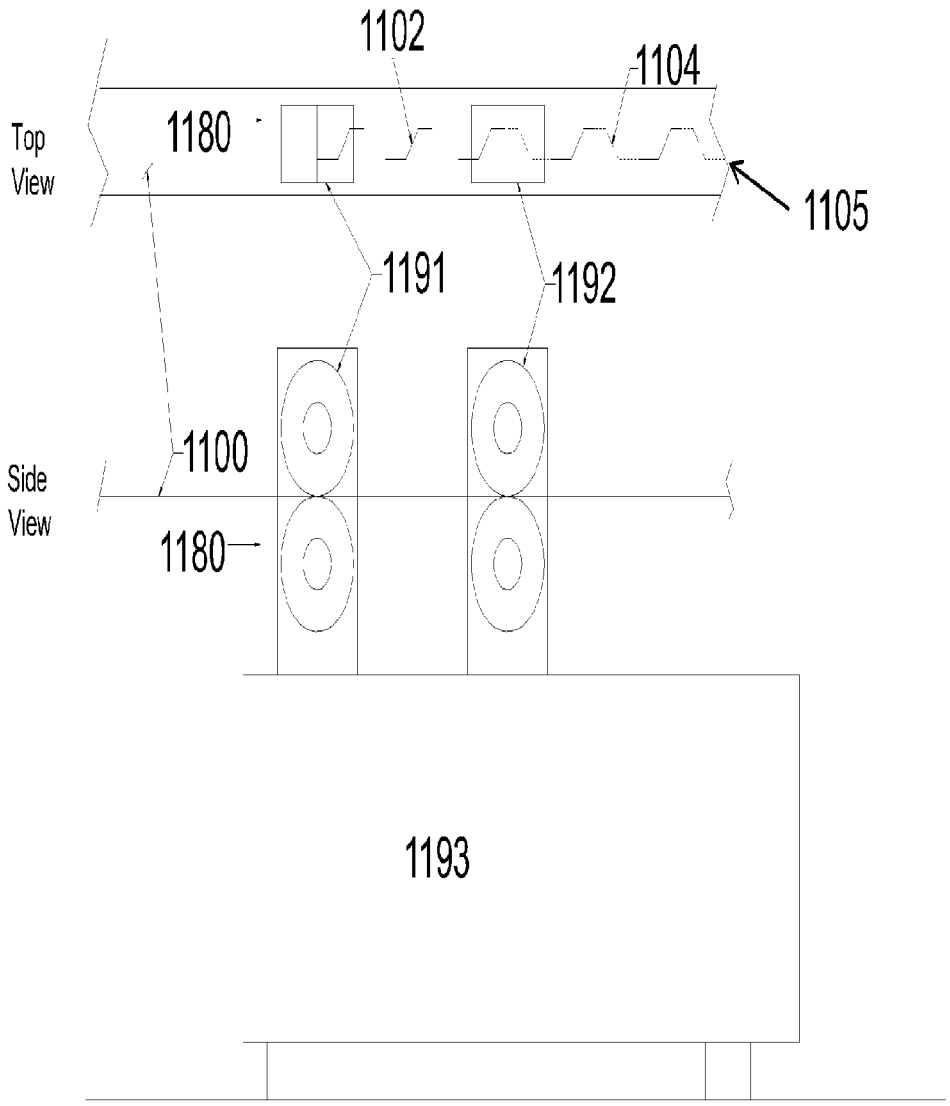
FIG. 11 includes a top view and a side view of a system for manufacturing a metal construction member.

FIG. 11 shows a diagram of an example of a pair of radial cutting tools and their relationship to making a variable pitch pattern. A pair of radial cutting tools 1191, 1192 can be mounted on a machine base 1193.

Referring to FIG. 11, another method to achieve a variable pitch pattern can include a computer controlled pair of radial cutting tools 1191, 1192 that can allow the repeating unit length of a pattern to be adjusted. A metal sheet 1100 can traverse along in a direction 1180. A first radial cutting tool 1191 can punch or cut a first portion 1102 of a repeating unit 1135 into a metal sheet 1100. A second radial cutting tool 1192 can punch or cut a second portion 1104 of a repeating unit 1135 into a metal sheet 1100. The first radial cutting tool 1191 and the second radial cutting tool 1192 can together create a continuous nonlinear slit 1105 in the metal sheet 1100. The speed of the rolls relative to the material speed and relative to each other can result in an adjustable repeating unit length. If beads or flanging are required on the member, there can also be radial embossment and/or flanging tools (not shown), for example in pairs, that would be controlled in conjunction with the pair of cutting tools in order to get the variable patterns necessary.

A combination of actuator controlled cutting tool and radial embossment tools can be utilized to achieve the desired production system and part design.

The reduction of raw material used can substantially reduce the cost to manufacture, while it can add to the functional attributes of reduced thermal and sound transmission. A metal construction member as described can give the manufacturer a strong competitive advantage.

A number of embodiments have been described. Nevertheless, it will be understood that various modifications may be made without departing from the spirit and scope of the concepts described above. Accordingly, other embodiments are within the scope of the claims.

What is claimed is:

1. A metal construction member, comprising:

at least two metal strips, each metal strip having a continuous nonlinear pattern along an at least one lengthwise edge of the strip wherein the at least two metal strips include all of the metal from a single metal sheet, wherein the continuous nonlinear pattern includes a plurality of repeating units that are void-free and each repeating unit includes a plurality of straight lengths and an at least one joining region having a straight length that is a portion of a length of the repeating unit and which protrudes away from a lengthwise axis of the metal strip, and at least one of the metal strips are joined to at least one other metal strip at a plurality of adjacent joining regions and the at least two metal strips include a reinforcement across the at least one joining region, wherein the reinforcement is a bead or flange formed from the two metal strips, wherein the plurality of adjacent joining regions of the first metal strip are joined with the plurality of adjacent joining regions of the second metal strip creates a plurality of voids, wherein the plurality of voids are defined by the continuous nonlinear pattern of a first metal strip and the continuous nonlinear pattern of a second metal strip.

2. The metal construction member of claim 1, further comprising a plurality of voids, wherein a void is defined by the continuous nonlinear pattern of a first metal strip and the continuous nonlinear pattern of a second metal strip when the first metal strip is joined to a second metal strip at a plurality of adjacent joining regions.

3. The metal construction member of claim 1, wherein the at least two metal strips include metal from a single metal sheet.

4. The metal construction member of claim 1, wherein each joining region has a width, and wherein a joining region on a first metal strip and a joining region on a second metal strip that are joined have an equivalent width.

5. The metal construction member of claim 1, wherein each repeating unit includes a first half and a second half, such that the second half is a mirror image of the first half.

6. The metal construction member of claim 1, wherein the at least two metal strips are welded to at least one other metal strip at a plurality of adjacent joining regions.

7. The metal construction member of claim 1, wherein the at least two metal strips include a reinforcement.

8. The metal construction member of claim 7, wherein the reinforcement is around the plurality of voids.

9. The metal construction member of claim 7, wherein the reinforcement includes a flange.

10. The metal construction member of claim 7, wherein the reinforcement includes a bead, dart or dimple.

11. The metal construction member of claim 1, wherein the metal construction member is a c-section member.

12. The metal construction member of claim 1, wherein the metal construction member is a track member.

13. A method of building a structure comprising:

placing a metal construction member in a portion of a structure, wherein the metal construction member includes at least two metal strips, each metal strip having a continuous nonlinear pattern along an at least one lengthwise edge of the strip, wherein the at least two metal strips include all of the metal from a single metal sheet, wherein the continuous nonlinear pattern includes a plurality of repeating units that are void-free, and each repeating unit includes a plurality of straight lengths and at least one joining region having a straight length that is a portion of a length of the repeating unit and which protrudes away from a lengthwise axis of the metal strip, and at least one of the metal strips is joined to at least one other metal strip at a plurality of adjacent joining region and the at least two metal strips include a reinforcement across the at least one joining region, wherein the reinforcement is a bead or flange formed from the two metal strips, wherein the plurality of adjacent joining regions of the first metal strip are joined with the plurality of adjacent joining regions of the second metal strip creates a plurality of voids, wherein the plurality of voids are defined by the continuous nonlinear pattern of a first metal strip and the continuous nonlinear pattern of a second metal strip.

14. A method of manufacturing a metal construction member comprising:

forming at least two metal strips, each metal strip having a continuous nonlinear pattern along an at least one lengthwise edge of the strip, wherein the at least two metal strips include all of the metal from a single metal sheet, wherein the continuous nonlinear pattern includes a plurality of repeating units that are void-free and each repeating unit includes plurality of straight lengths and at least one joining region having a straight length that is a portion of a length of the repeating unit and which protrudes away from a lengthwise axis of the metal strip, aligning a plurality of adjacent joining regions of one metal strip with a plurality of adjacent joining regions of the other metal strip; and joining at least one metal strip to at least one other metal strip at the plurality of adjacent joining regions, thereby forming the metal construction member wherein the at least two metal strips include a reinforcement across the at least one joining region, and the reinforcement is a bead or flange formed from the two metal strips wherein joining the plurality of adjacent joining regions of the first metal strip with the plurality of adjacent joining regions of the second metal strip creates a plurality of voids, wherein the plurality of voids are defined by the continuous nonlinear pattern of a first metal strip and the continuous nonlinear pattern of a second metal strip.

15. The method of claim 14, wherein forming at least two metal strips includes creating a continuous nonlinear slit in a metal sheet.

16. The method of claim 15, wherein forming at least two metal strips further includes separating the metal sheet into the at least two metal strips along the at least one continuous nonlinear slit.

17. The method of claim 15, wherein forming the at least one continuous nonlinear slit includes cutting or punching the slit into the metal sheet.

18. The method of claim 17, wherein the at least one continuous nonlinear slit is cut or punched into the metal sheet by a rotary slitter, punch press, radial embosser, laser cutter, plasma cutter or water jet cutter.

19. The method of claim 14, wherein aligning a plurality of adjacent joining regions of a first metal strip with a plurality of adjacent joining regions of a second metal strip includes shifting the first metal strip relative to the second metal strip a distance equivalent to a fraction the length of a repeating unit.

20. The method of claim 14, wherein the first metal strip is shifted relative to the second metal strip a distance equivalent to one half of the length of a repeating unit.

21. The method of claim of claim 14, wherein each repeating unit includes a first half and a second half, such that the second half is a mirror image of the first half.

22. The method of-claim 14, wherein joining the plurality of adjacent joining regions of the first metal strip with the plurality of adjacent joining regions of the second metal strip includes welding.

23. The method of claim 14, wherein the method further includes modifying a portion of the metal strips to include a reinforcement.

24. The method of claim 23, wherein the reinforcement is around the plurality of voids.

25. The method of claim 23, wherein the reinforcement includes a flange.

26. The method of claim 23, wherein the reinforcement includes a bead, dart or dimple.

27. The method of claim 14, wherein the method further includes forming the metal construction member into a c-section member.

28. The method of claim 14, wherein the plurality of voids are positioned by adjusting a distance (lr) equivalent to the length of the repeating unit to ensure voids are aligned along the length of a member.

* * * * *